US008161780B1

(12) United States Patent
Huml

(10) Patent No.: US 8,161,780 B1
(45) Date of Patent: Apr. 24, 2012

(54) THUMB OPERATED DOOR LOCK ASSEMBLY

(75) Inventor: Jan M. Huml, Medford, WI (US)

(73) Assignee: G-U Hardware, Inc., Newport News, VA (US)

( * ) Notice: Subject to any disclaimer, the term of this patent is extended or adjusted under 35 U.S.C. 154(b) by 0 days.

(21) Appl. No.: 12/657,375

(22) Filed: Jan. 19, 2010

Related U.S. Application Data

(60) Provisional application No. 61/205,462, filed on Jan. 16, 2009.

(51) Int. Cl.
*E05B 59/00* (2006.01)

(52) U.S. Cl. ..... 70/107; 70/109; 70/DIG. 42; 292/34; 292/39; 292/142

(58) Field of Classification Search ..... 70/107–111, 70/DIG. 42; 292/34, 39, 40, 142, 143, 347, 292/DIG. 62
See application file for complete search history.

(56) References Cited

U.S. PATENT DOCUMENTS

| | | | | | |
|---|---|---|---|---|---|
| 3,390,558 | A | * | 7/1968 | Hegedus et al. | 70/107 |
| 4,052,092 | A | * | 10/1977 | Bergen | 292/172 |
| 4,156,541 | A | * | 5/1979 | Babb et al. | 292/21 |
| 4,418,552 | A | * | 12/1983 | Nolin | 70/107 |
| 4,709,565 | A | * | 12/1987 | Lin | 70/107 |
| 4,838,053 | A | * | 6/1989 | Shen | 70/92 |
| 4,979,767 | A | * | 12/1990 | Lin | 292/336.3 |
| 4,999,950 | A | | 3/1991 | Beske et al. | |
| 5,161,837 | A | * | 11/1992 | O'Brien, II | 292/40 |
| 5,184,852 | A | * | 2/1993 | O'Brien | 292/40 |
| 5,290,077 | A | | 3/1994 | Fleming | |
| 5,498,038 | A | | 3/1996 | Simon et al. | |
| 5,611,227 | A | | 3/1997 | Solovieff | |
| 5,655,393 | A | * | 8/1997 | Kuo et al. | 70/107 |
| 5,697,654 | A | | 12/1997 | MacDonald | |
| 5,787,741 | A | * | 8/1998 | Shen | 70/107 |
| 5,820,173 | A | | 10/1998 | Fuller | |
| 5,881,585 | A | * | 3/1999 | Kang | 70/107 |
| 5,911,763 | A | | 6/1999 | Quesada | |
| 5,915,764 | A | | 6/1999 | MacDonald | |
| 6,209,931 | B1 | | 4/2001 | Von Stoutenborough et al. | |
| 6,257,030 | B1 | | 7/2001 | Davis, III et al. | |
| 6,282,929 | B1 | | 9/2001 | Eller et al. | |
| 6,327,881 | B1 | | 12/2001 | Grundler et al. | |
| 6,386,602 | B1 | * | 5/2002 | Lan | 292/336.3 |
| 6,389,855 | B2 | * | 5/2002 | Renz et al. | 70/107 |
| 6,564,596 | B2 | | 5/2003 | Huang | |

(Continued)

FOREIGN PATENT DOCUMENTS

| | | |
|---|---|---|
| EP | 1533452 | 5/2005 |

(Continued)

*Primary Examiner* — Lloyd Gall
(74) *Attorney, Agent, or Firm* — James Creighton Wray

(57) ABSTRACT

A thumb operated door latch and lock assembly has an exterior grip and thumb lever, a motion converter, a key cylinder, a strengthening plate and an interior latch lever and locking knob. The thumb lever moves the converter which turns a latch tongue that extends through a receiver in the latch assembly. The interior lever turns a limited engagement interior hub collar. A figure eight opening in the collar turns the latch tongue to withdraw the latches. Turning the interior lever upward disables the thumb lever. Turning the lever to withdraw the latches moves a slide upward within guide plates. The slide turns an interior lever and an extended tongue on the key cylinder to withdraw the dead bolt simultaneously with the latches.

8 Claims, 3 Drawing Sheets

U.S. PATENT DOCUMENTS

| | | | | |
|---|---|---|---|---|
| 7,025,394 | B1 | 4/2006 | Hunt | |
| 7,036,856 | B2 * | 5/2006 | Fishencord | 292/336.3 |
| 7,257,973 | B2 * | 8/2007 | Romero et al. | 70/107 |
| 7,287,787 | B1 | 10/2007 | Tannone | |
| 7,290,808 | B2 * | 11/2007 | Furlong | 292/336.3 |
| 7,364,212 | B1 * | 4/2008 | Fan | 292/336.3 |
| 7,404,306 | B2 | 7/2008 | Walls et al. | |
| 7,421,868 | B2 | 9/2008 | Matyko et al. | |
| 7,523,971 | B2 * | 4/2009 | Ebert | 292/358 |
| 7,748,759 | B2 * | 7/2010 | Chen et al. | 292/347 |
| 2004/0004359 | A1 | 1/2004 | Wartian | |
| 2005/0092040 | A1 * | 5/2005 | Chuang | 70/107 |
| 2005/0262906 | A1 * | 12/2005 | Romero et al. | 70/107 |
| 2006/0053846 | A1 * | 3/2006 | Huang et al. | 70/107 |
| 2007/0080541 | A1 | 4/2007 | Fleming | |
| 2007/0137267 | A1 * | 6/2007 | Pilatowicz et al. | 70/107 |
| 2008/0256994 | A1 | 10/2008 | Walls et al. | |

FOREIGN PATENT DOCUMENTS

| | | |
|---|---|---|
| GB | 2229488 | 9/1990 |
| WO | WO0075466 | 12/2000 |
| WO | WO01/59237 | 8/2001 |
| WO | WO2007/082022 | 7/2007 |

* cited by examiner

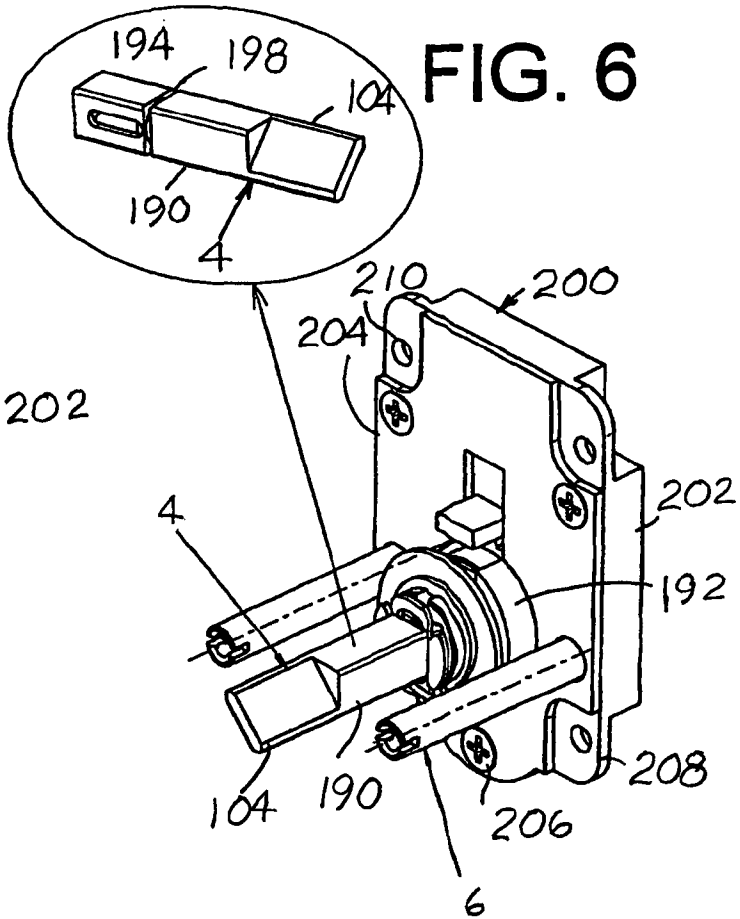
FIG. 6
FIG. 5
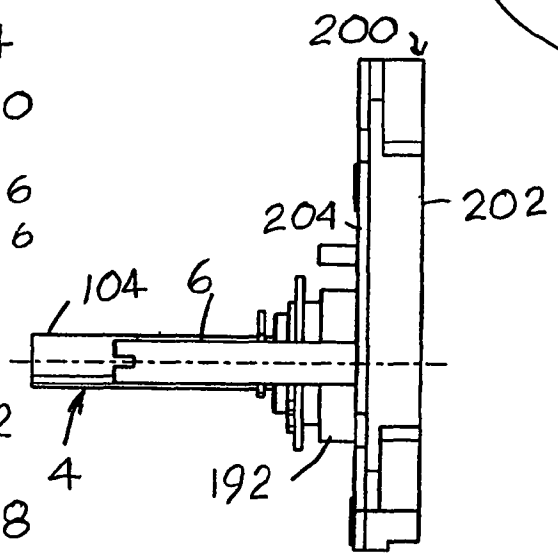
FIG. 4
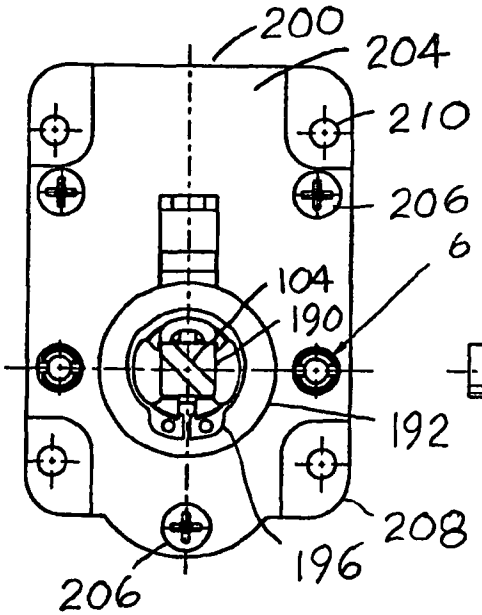
FIG. 3

THUMB OPERATED DOOR LOCK ASSEMBLY

This application claims the benefit of U.S. Provisional Application No. 61/205,462, filed Jan. 16, 2009, which is hereby incorporated by reference in its entirety as if fully set forth herein.

SUMMARY OF THE INVENTION

The disclosures of U.S. Pat. Nos. 6,327,881 and 6,389,855 are hereby incorporated by reference in their entirety as if fully set forth herein.

The new grip-set uses the traditional thumb-operated exterior thumb lever, which retracts the multi-point latching gear. The in-door latch and deadbolt gear operators are already patented by G-U Germany. The new total system and the new elements are the subject of this invention.

Features of the invention include:

1. Multi-point door locking system with thumb operated retraction
2. Simultaneous retraction of the deadbolt when the interior lever is operated (panic mode)
3. Reduced warping of exterior entry door panels
4. Independent deadbolt operation from multi-point gear operation.

These and further and other objects and features of the invention are apparent in the disclosure, which includes the above and ongoing written specification, with the drawings.

BRIEF DESCRIPTION OF THE DRAWINGS

FIG. 3 is a door-side rear elevational view of the exterior latch withdrawal assembly and the limited engagement drive spindle shown in FIGS. 1 and 2.

FIG. 4 is a right side elevational view of the exterior latch withdrawal assembly and limited engagement drive spindle, shown in FIGS. 1-3.

FIG. 5 is a perspective view showing the back, right side and top of the exterior latch withdrawal assembly and limited engagement drive spindle shown in FIGS. 3 and 4.

FIG. 6 is a detail of the limited engagement drive spindle shown in FIGS. 1-5.

DETAILED DESCRIPTION OF THE DRAWINGS

Figure 1:
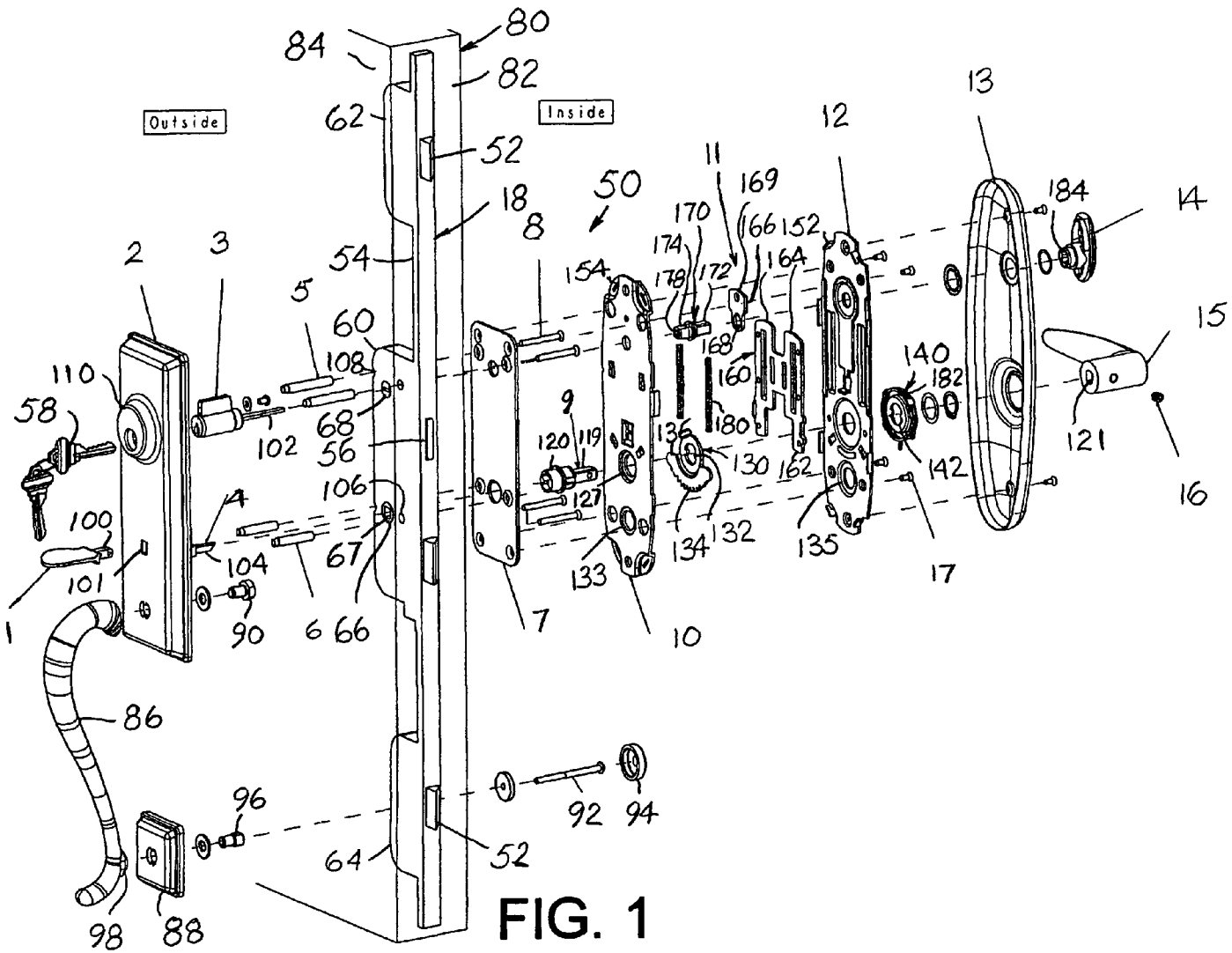
FIG. 1 is an exploded perspective view of the thumb operated door lock.

In FIGS. 1 and 2A, 2B and 2C, a multi-point latch and deadbolt system 50 is shown mounted in an edge 82 of a door 80. Door 80 is pulled shut allowing spring mounted latches 52 to be pushed inward and then to extend outward into receivers in a door jamb from housing 54 of the G-U Hardware Eagle Multi-Point Gear Assembly 18, as shown, for example, in U.S. Pat. No. 6,389,855. A deadbolt is extended through opening 56 by turning a key 58 in key lock cylinder 3 or by turning interior locking knob 14. Extending the deadbolt also operates within the patented assembly 18 to prevent unintended inward movement of the latches, holding the latches 52 in extended position.

The main body 60 of the latch and deadbolt Multi-Point Gear Assembly 18 holds the latch and deadbolt operator for extending and withdrawing a deadbolt through opening 56. Auxiliary upper and lower bodies 62 and 64 and main body 60 hold the operator mechanisms for extending, locking and withdrawing the upper, lower and central latches 52.

Turnable receiver 66 in main body 60 of assembly 18 turns an operator to withdraw latches 52. Turnable receiver 68 in body 60 turns an operator in assembly 18 to move the deadbolt out or in through opening 56. When the deadbolt is extended, assembly 18 prevents inward movement of the latches 52, providing a four-point lock. Withdrawing the deadbolt permits inward movement of the latches 52 by thumb lever 1 or interior lever 15. The assembly 18 may be configured so that the deadbolt extension does not prevent inward movement of the latches. Interior lever 15 simultaneously withdraws the latches and deadbolt.

An exterior escutcheon plate 2 and grip handle assembly is mounted on the outside 84 of door 80. A thumb lever 1 is mounted directly above the fixed grip handle 86. Bolt 90 extends from the inner side of plate 2 to secure the top of handle 86. The bottom of handle 86 is secured to a bottom plate 88 by a long screw 92, which extends through an interior cup 94, the door 80, a sleeve 96 and plate 88. Screw 92 engages nut 98 secured to the bottom of handle 86.

Thumb lever 1 has an extension 100 which extends through opening 101 in plate 2. Thumb lever 1 is pivoted on a pin extending through a hole in extension 100 on the inside of plate 2. A linear to rotary motion converter, for example a rack connected to extension 100 and a pinion connected to the rack, turn the limited engagement drive spindle 4 and its extended tongue 104 when thumb lever 1 is depressed. Tongue 104 fits diagonally through the square opening 67 of receiver 66, and a square cross section base 190 of spindle 104 fits in the square opening 67 in receiver 66 to turn the operator in assembly 18 for withdrawing latches 52.

Key 58 fits through an outer case 110 which holds key lock cylinder 3 partially inside plate 2 and door 80. Tongue 102 extends from lock cylinder 3 through the rectangular opening in receiver 68 and turns the receiver to move the deadbolt operator in assembly 18 to extend or withdraw the deadbolt.

Key cylinder mounting screw supports 5 and lever drive hub screw supports 6 fit through the door 80 and through openings 106 and recesses 108 in the main body 60 of assembly 18 to receive interior mounting screws 8, which secure interior mounting support plate 7 and exterior escutcheon plate 2 to each other and to the door, strengthening the door.

Limited engagement interior hub collar 9 has a square cross section extension 119 which fits in the square opening 121 in interior latch operating lever 15 and is held there by lever mounting set screw 16.

Figure 2A:
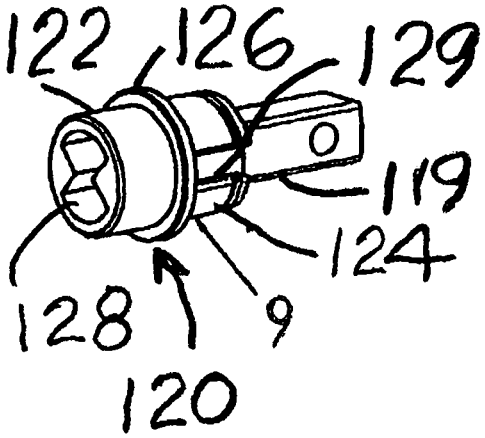
FIGS. 2A, 2B and 2C show details of the limited engagement interior hub collar and limited engagement drive spindle shown in FIG. 1.
Figure 2B:
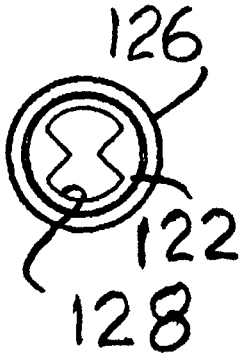
Figure 2C:
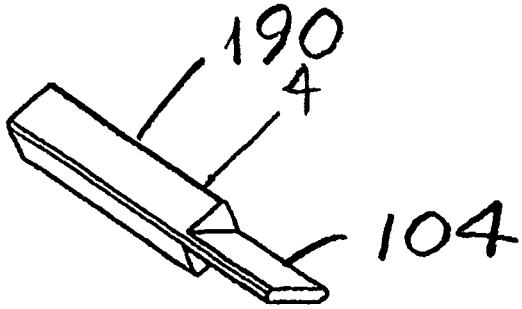

As shown in FIGS. 2A and 2B, collar 9 has a main cylindrical body 120 with outer part 122 and inner part 124 separated by a flange 126. Flange 126 on collar 9 is received in complementary recess 127 in plate 10. The body 120 and its extension and outer and inner parts rotate together. The outer part 122 has a generally radially opposite sectoral FIG. 8 shaped recess 128 which receives tongue 104 of limited engagement drive spindle 4. The sectoral recesses permit interior lever 15 to be raised, turning the body 120 so that radial faces of the recess 128 are spaced from tongue 104 to prevent latches 52 to be withdrawn by moving thumb lever 1. Thus, thumb lever 1 is disabled when interior lever 15 is raised. Sectoral recess 128 prevent turning of the element 120 by the thumb lever 1 sufficiently to raise plate 160 and withdraw the deadbolt.

Diametrically opposite slots 129 in the cylindrical body inner part 124 receive projections 132, 142 which extend inward from rotating elements 130 and 140 in interior simultaneous retraction assembly 11.

Assembly 11 has two plates, interior simultaneous retraction inside base plate 10 and interior simultaneous retraction outside base plate 12. Plates 10 and 12 are held together by lugs 152 fitted into slots 154. Short assembly screws 17 are connected through openings in the plates 10 and 12 to threaded openings or nuts in interior mounting support plate 7 to hold plates 10 and 12 assembled on the support plate 7.

Element 130 has a segmental gear 134. Gear 134 engages a gear on an axle (not shown) extending between large openings 133 and 135 in plates 10 and 12 to provide smooth operation of the interior simultaneous retraction assembly 11.

Element 130, sliding plate 160 and lever 169 turn connector 170, tongue 102 and receiver 68 to withdraw the deadbolt, if it is extended, when the interior operating lever 15 is turned to withdraw latches 52. Upper edges 136 of element 130 engage lower edges 162 of sliding plate 160 and lift the sliding plate when lever 15 turns element 130. Upper curved edges 164 of sliding plate 160 engage edges 166 of lock turner lever 169 in interior simultaneous retraction assembly 11. When the interior operating lever 15 is turned to open the door, element 130 is rotated. One of its edges 136 lifts an edge 162 and sliding plate 160. An upper edge 164 of sliding plate 160 moves an edge 166 and lock lever 169 to simultaneously turn receiver 68 to withdraw the deadbolt, as lever 15 withdraws latches 52.

Springs 180 keep sliding plate 160 in contact with element 130 and keep element 130 level. Springs 182 on element 140 keep element 140 centered, keeping interior operating lever 15 horizontal and latches 52 in outward positions.

Square opening 168 of lock lever 169 in assembly 11 engages the square extension 172 of lock connector 170. The same square extension 172 is received in the square axial opening 184 in the interior locking knob 14.

The outer facing end 174 of connector 170 has a rectangular slot opening 178 to receive tongue 102 which extends from key lock cylinder through turnable lock operating receiver 68 and into opening 178.

As shown in FIGS. 2A-6, the limited engagement drive spindle 4 has a square cross section base 190 which is mounted in a turning mechanism 192. The turning mechanism converts the linear arcuate motions of the thumb lever 1 and its extension 100 to rotary motion for turning drive spindle 4. The linear to rotary motion may be provided by a rack gear attached to the inner end of the thumb lever extension 100 and a pinion gear having a central recess for receiving end 194 of spindle 4. Spring clip 196 fits in groove 198 of the spindle to hold the spindle in the turning assembly 192. Lever drive hub screw supports 6 are shown connected to the casing 200, which is attached to outside exterior escutcheon plate 2 with screws 8.

Casing 200 has a body 202 and a cover 204 which is attached to the body by screws 206. Ears 208 on the body 202 have openings 210 for screws to secure the turning assembly 192 to plate 2.

In the drawings, the following numbers refer to the following elements.

| Item Number | Description |
|---|---|
| 1 | Thumb Lever |
| 2 | Exterior Escutcheon Plate & Grip Handle |
| 3 | Key Cylinder |
| 4 | Limited Engagement Drive Spindle |
| 5 | Key Cylinder mounting screw supports |
| 6 | Lever Drive Hub screw supports |
| 7 | Interior Mounting Support Plate |

-continued

| Item Number | Description |
|---|---|
| 8 | Interior Mounting Screws |
| 9 | Limited Engagement Interior Hub Collar |
| 10 | Interior Simultaneous Retraction Inside Base Plate |
| 11 | Interior Simultaneous Retraction Assembly |
| 12 | Interior Simultaneous Retraction Outside Base Plate |
| 13 | Interior Escutcheon Plate |
| 14 | Interior Locking Knob Assembly |
| 15 | Interior Operating Lever |
| 16 | Lever Mounting Set-Screw |
| 17 | Interior Simultaneous Retraction assembly screws |
| 18 | G-U Hardware Eagle Multi-Point Door Gear Assembly |

While the invention has been described with reference to specific embodiments, modifications and variations of the invention may be constructed without departing from the scope of the invention.

I claim:

1. A thumb operated door lock apparatus for an entry door comprising:

an in-door housing having door latches and a deadbolt, a first turnable receiver in the housing for operating the deadbolt, a second turnable receiver in the housing for operating the latches, an outer escutcheon plate and a grip handle for mounting on the outside of the entry door, an inner mounting support plate for mounting inside the entry door opposite the outer escutcheon plate, screws extending through the inner mounting support plate, through the door, through the in-door housing and into the outer escutcheon plate for holding the inner plate and the outer escutcheon plate and grip handle tight against the entry door for strengthening the entry door, a key cylinder mounted between the outer escutcheon plate and the in-door housing, the key cylinder having a first turnable tongue extending through the first receiver for turning the first receiver and operating the deadbolt, a thumb lever extending outward from an opening in the outer escutcheon plate, an extension on the thumb lever extending inward through the opening, a horizontal pin extending through a hole in the extension for allowing the thumb lever and extension to pivot around the pin, a motion converter connected to the extension for converting up and down motion of an end portion of the extension to a rotary motion, a second turnable tongue extending inward from the motion converter through the second receiver, first and second base plates connected to the inner mounting support plate, a slide plate mounted between the base plates, a slide operator mounted between the base plates, a first connector mounted between the base plates and receiving the first tongue, a second connector mounted between the base plates for receiving the second tongue, an interior escutcheon plate mounted on the base plates, an interior locking knob mounted on the first connector, an interior operating lever mounted on the second connector, for turning the slide operator mounted on the second connector for lifting the slide plate, a lock lever mounted on the first connector and operably connected to the slide plate for turning the first connector and operating the deadbolt when the slide plate is lifted by turning the interior operating lever.

2. The apparatus of claim 1, wherein extension of the deadbolt prevents inward movement of the latches.

3. The apparatus of claim 1, wherein extension of the deadbolt is independent of operation of the latches.

4. The apparatus of claim 1, wherein the second connector has a FIG. 8 shaped segmented opening for receiving the second tongue, wherein movement of the interior operating lever turns the second connector for separating sides of the segmented opening away from the second tongue and preventing movement of the second connector by the second tongue.

5. The apparatus of claim 1, wherein the second connector has a first part which extends through the slide operator into the interior lever.

6. The apparatus of claim 5, wherein the first part of the second connector has opposite longitudinal grooves and wherein the slide operator has inward extensions fitting in the grooves for turning the slide operator with the second connector.

7. The apparatus of claim 6, further comprising springs mounting between the base plates for moving the slide plate downward against the slide operator.

8. The apparatus of claim 6, further comprising a ring mounted on the first part of the second connector between the interior escutcheon plate and one of the base plates, the ring having inward extensions fitted in the opposite grooves and springs connected to the ring for returning the interior operating lever to horizontal position.

* * * * *